US006029857A

United States Patent [19]

Keller

[11] Patent Number: 6,029,857

[45] **Date of Patent: *Feb. 29, 2000**

[54] DISPENSING APPLIANCE FOR AT LEAST TWO COMPONENTS

[76] Inventor: Wilhelm A. Keller, Obstgartenweg 9, CH-6402 Merlischachen, Switzerland

[ * ] Notice: This patent is subject to a terminal disclaimer.

[21] Appl. No.: 08/791,402

[22] Filed: Jan. 30, 1997

[30] Foreign Application Priority Data

Jan. 31, 1996 [EP] European Pat. Off. ..... 96810066

[51] Int. Cl.[7] ..... B05C 17/005

[52] U.S. Cl. ..... 222/137; 222/134; 222/144.5; 222/145.1; 222/145.6

[58] Field of Search ..... 222/134, 137, 222/144.5, 145.1, 145.6

[56] References Cited

U.S. PATENT DOCUMENTS

| | | | |
|---|---|---|---|
| 3,570,719 | 3/1971 | Schiff | 222/137 |
| 4,690,306 | 9/1987 | Stäheli | 222/80 |
| 4,981,241 | 1/1991 | Keller | 222/137 |
| 5,092,492 | 3/1992 | Centea | 222/137 |
| 5,263,614 | 11/1993 | Jacobsen et al. | 222/137 |
| 5,370,273 | 12/1994 | Rohloff et al. | 222/145.1 |
| 5,447,987 | 9/1995 | Keller | 222/137 |

FOREIGN PATENT DOCUMENTS

| | | | |
|---|---|---|---|
| 0 294 672 | 12/1988 | European Pat. Off. . | |
| 0 607 102 | 7/1994 | European Pat. Off. . | |
| 1454898 | 2/1969 | Germany | 222/137 |
| 92/20460 | 11/1992 | WIPO . | |

*Primary Examiner*—J. Casimer Jacyna
*Attorney, Agent, or Firm*—Foley & Lardner

[57] ABSTRACT

The dispensing appliance for at least two components comprises a metering pump assembly with a housing comprising a metering cylinder for each component, each metering cylinder having an inlet and an outlet and a displacement plunger. The metering cylinders have eccentric outlet noses which end in a double outlet with a common outlet nozzle having their centers on a straight line which connects the centers located of the two metering cylinders and between the centers of the metering cylinders. In a preferred embodiment the cross sectional area of any pair of cylinder/displacement plunger combination between ratios of 1:1 and 20:1 is substantially equal. Such an assembly is modular, lightweight, highly compact, cost effective and can be easily disassembled for cleaning and maintenance.

21 Claims, 6 Drawing Sheets

DISPENSING APPLIANCE FOR AT LEAST TWO COMPONENTS

BACKGROUND OF THE INVENTION

The present invention pertains to a dispensing appliance for at least two components, comprising a pump assembly with a housing containing a metering cylinder for each component, each metering cylinder having an inlet and an outlet and a displacement plunger, each of the inlets being connected to a container which holds one of the components and the outlets of the pumps ending in a common outlet, the pump assembly being held in a frame comprising frame plates on the dispensing side and on the drive side thereof, the plates being detachably connected to each other by means of tie rods, in particular to a compact hand-held appliance.

Such an appliance is known from European Patent Application No. 607,102, disclosing rather schematically the principles of an appliance with a frame and housing which can be easily dismantled and reassembled. This is also the case for the path of the outlets of the cylinders into the common outlet nozzle, which is relatively long and contains therefore a relatively high volume of liquid which can cause air bubble entrapment. There is no defined sealing between the metering cylinder front face and the double outlet and therefore pressure can build up between their respective plane surfaces resulting in an axial force compressing the internal parts including seals contained in the pump housing.

In the above mentioned appliance for two components, the pairs of metering cylinder/displacement plunger combinations for achieving different ratio do not provide uniform metering pressures for the different ratios.

Furthermore, within the pump housing, the internal assembly of rear spacers, rear displacement plunger seals, inlet spacers, metering seals and metering cylinders may be axially compressed without limitation by the tie rods, resulting in uncontrollable friction between metering seals and displacement plungers thus reducing available pump pressure and allowing a variation in seal efficiency and potential damage to those seals.

PCT/GB92/00813 discloses an appliance, referring however primarily to the storage container, while U.S. Pat. No. 4,690 306 discloses a method and device for storing, mixing and dispensing of at least two fluid substances, wherein the device is assembled in a sort of frame with relatively complicated pieces, and the containers are disposable.

As with most developing technological products, there comes a time for standardization of requirements and specifications such that the production of high cost "one off" equipment can, in the main, be replaced by mass produced and relatively low cost units. The field of high performance multi component reactive chemical systems such as epoxies and polyurethanes is no exception with the use of pumping, metering, mixing and dispensing machines. Such machines tend to be relatively expensive and technically complicated whereas the ideal is to reduce the complexity and cost of a multi component system to that of a single component system. The need, therefore, is for machines to be standardized around a basic operating specification, which makes them simple to use, compact, lightweight as hand held portable devices for use with relatively low volume exchangeable chemical component packages for low volume dispensing applications, yet are easily convertible to bench or robot mounting with direct feed of the chemical components from larger containers for higher volume dispensing applications. Also there is the need to provide for interchangeable parts to cover the many different relative mixing ratios of the chemical components and for a quick disassembly of all parts for ease of servicing.

Finally, a high degree of performance and reliability is required while providing both accurate relative metering ratios and the necessary accuracy of the simultaneous start of flow of both metered chemical component streams through a static mixer at the time of dispensing commencement. The latter being preferably achieved by the ratio metering taking place immediately before the mixer and therefore close to the point of dispensing of the mixed chemical components, thus avoiding undue compression of non hydraulic chemicals and resultant inaccuracy of metering due to conventional long conduits between the metering pumps and the point of dispensing.

SUMMARY OF THE INVENTION

On the basis of the above mentioned prior art, it is a first object of the present invention to provide for the further refinement of the prior art appliance in the form of a multi-component metering and mixing dispensing appliance, namely for two or three components, which provides for the most direct pathway for liquid transfer from the metering chambers to the common outlet nozzle and avoids any undue axial compression due to internal hydraulic forces causing the internal assembly of the pump housing to compress the seals. This object is attained with an appliance wherein the metering cylinders have eccentric outlet noses having their centers located on a straight line which connects the centers of the metering cylinders and between the centers of the metering cylinders.

It is a second object of the invention to provide for an appliance with two components which ensures similar metering pressures, whatever the ratio of the cross-sectional area of the pairs of metering cylinder/displacement plunger combinations are. This object is attained with an appliance, wherein the total area of any pair of relative ratio forming metering cylinder/displacement plunger combinations within the range from 1:1 to 20:1 is substantially equal.

The further objects of the invention are to provide for an appliance which is lightweight, highly compact, easy to service and cost effective. These objects are attained with an appliance according to the dependent claims.

BRIEF DESCRIPTION OF THE DRAWINGS

The invention will be explained in more detail hereinafter with reference to a drawing of embodiments.

DETAILED DESCRIPTION OF THE INVENTION

The present invention is explained, by way of example, as a dispensing appliance for two components with an option for a third-small-component. Therefore, a double inlet and a double outlet are described within the examples.

Figure 1:
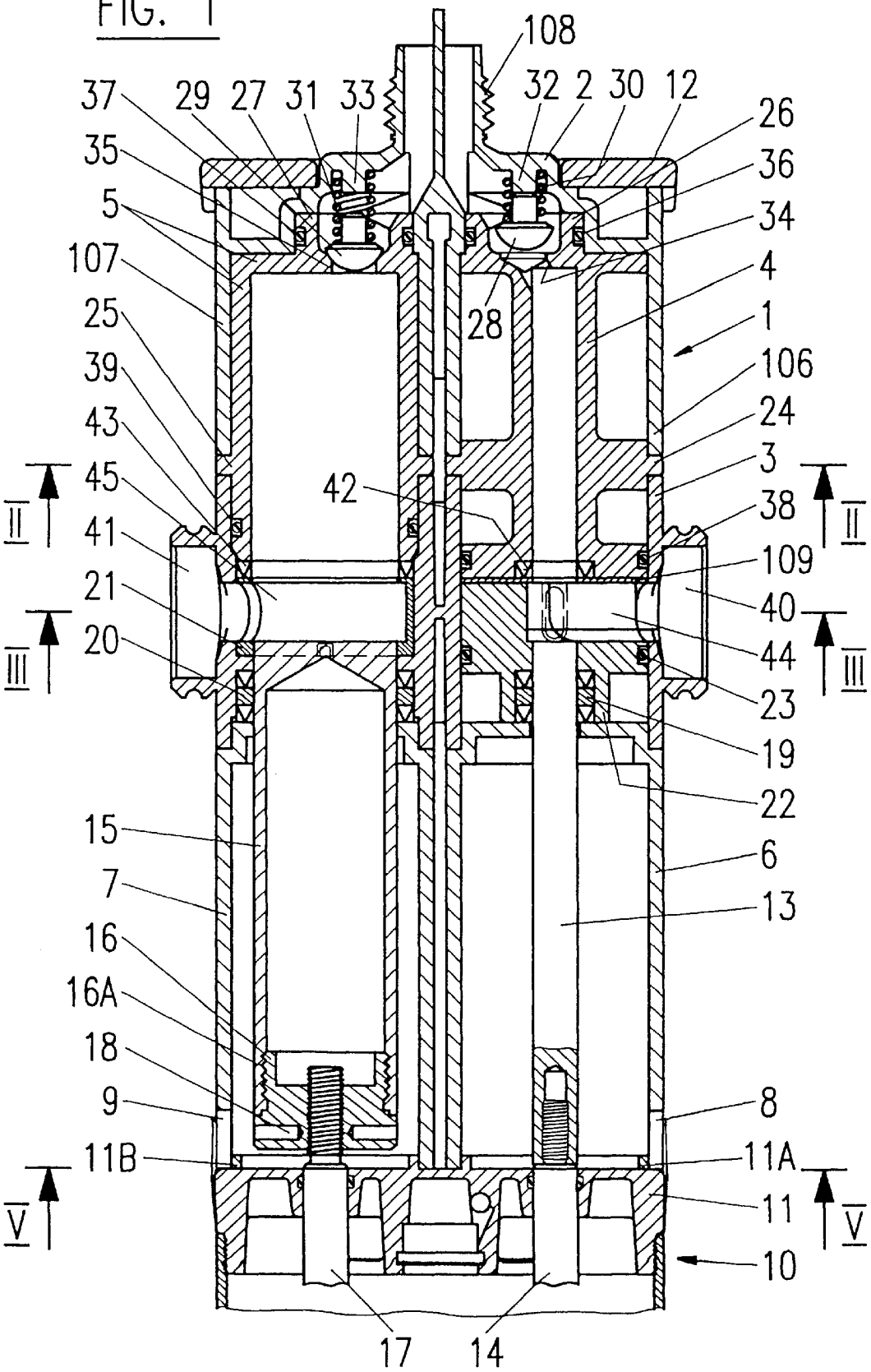
FIG. 1 shows in a sectional view a part of the dispensing appliance of the invention with two pump assemblies.

FIG. 1 shows a dispensing appliance for at least two components comprising a side by side metering pump assembly 1 consisting of three external housing sections, the front section being the double outlet 2 having two sleeves 106 & 107 as spacers and common outlet nozzle 108, the middle section being the double inlet 3 and the rear section being the rear sleeves 6 & 7. The external flanges 24 & 25 of the internal metering cylinders 4 & 5 a re secured between the double outlet 2 and the double inlet 3. The metering pump assembly is held by four tie rods, see FIG. 5, 80A–80D between the rear frame plate 11, as part of drive unit 10, and the front frame plate 12. This arrangement allows the rear seal assemblies 19 & 20 and the metering seals 42 & 43 to be retained within the metering pump assembly 1 and to be unaffected by compression causing internal hydraulic forces or by compressive forces through the action of being clamped together by means of the tie rods.

The rear frame plate 11 has alignment ridges 11A & 11B for properly locating and aligning the metering pump assembly. Rear sleeves 6 & 7 act as spacers and have cut outs 8 & 9 for observing potential rear seal leakage through wear and for axial metering plunger adjustment.

Within this metering pump assembly 1, a small diameter displacement plunger 13 is connected to the drive rod 14 and a larger diameter displacement plunger 15 is connected via an adjustable adaptor ring 16 to a drive rod 17, thus providing axial adjustment backwards or forwards for the displacement plunger 15 by means of a thread 16A and having radial holes 18 for adjustment via cut out 9.

Downstream of the inlets 40 & 41 and passageways 44 & 45, metering seals 42 & 43 seal against the displacement plungers 13 & 15 as they enter the metering cylinders 4 & 5, metering seal 42 being recessed within the opening of the metering cylinder 4 and retained there by the adjacent inlet spacer seal housing 22 and retaining disc 109 whereas metering seal 43, being the maximum size of seal and housed directly within the double inlet 3 and against the metering cylinder 5, is retained there by the adjacent inlet spacer 21.

At the rear of the double inlet 3, the displacement plungers 13 & 15 are sealed by the rear seal assemblies 19 & 20, comprising forward and rear facing seals with a spacer in between, which seal against liquid pressure on the displacement plunger forward stroke during displacement and against vacuum on the displacement plunger return stroke during reloading. The rear seal assemblies are located either directly within the double inlet 3 at the rear of the inlet spacer 21, as in the case of the use of a maximum diameter displacement plunger 15, or indirectly within the combined inlet spacer seal housing 22, such as in the case of the use of smaller diameter displacement plunger 13. Thus the rear seal assembly 20 also acts as a seal against the double inlet 3 whereas an O-ring 23 is required to seal between the inlet spacer seal housing 22 and the double inlet 3.

The front of the individual metering cylinders 4 & 5 have eccentric outlet noses 26 & 27 which, when positioned within the double outlet 2, have their centers located on a straight line which connects the centers of the two metering cylinders 4 & 5 and between the centers of the metering cylinders 4 & 5.

When assembled, the eccentric nose outlets 26 & 27 contain, on the same axis and downstream side, poppet valves 28 & 29 with stems which are guided and held by springs 30 & 31, or alternative guiding and holding means, the springs 30 & 31 being positioned on stroke limiting spigots 32 & 33 which are formed as part of the double outlet 2. The poppet valves 28 & 29 are spherical and seal against the tapered valve seats 34 & 35 forming pressure differential check valves. The metering cylinders 4 & 5 have O-rings 36 & 37 on the outer diameters of the eccentric nose outlets 26 & 27 as the sealing means against the internal bores of the double outlet 2 and O-rings 38 & 39 as the sealing means between the metering cylinders 4 & 5 and the double inlet 3, the latter having two individual inlets 40 & 41.

This embodiment thus provides for the minimum and preferably "in ratio" priming volume throughout the metering system and up to the point of the static mixer attachment so as to avoid as much compression and then decompression of non hydraulic chemicals as is possible during metering in order to maximize the relative ratio metering accuracy, hence, the eccentrically positioned outlet noses of the metering cylinders provide the most direct pathway for liquid transfer from the metering chambers to the requisite common outlet nozzle prior to mixing, thus minimizing the volume content and the chance of air bubble entrapment. The pressure differential check valves are positioned within the outlet noses and adjacent to the metering cylinders so that they immediately react to and tightly control the metering cylinder "swept" volume.

Furthermore, should the usual non hydraulic characteristic of the components be out of balance with each other and because of even minor dimensional differences or flexing of mechanical components under load, at least one piston is provided with a linear position adjustment relative to the other to ensure an exact and consistent start of flow of both chemical components at precisely the same time, thus avoiding an "off ratio" condition as they leave the metering area and enter a static mixer.

Figure 2:
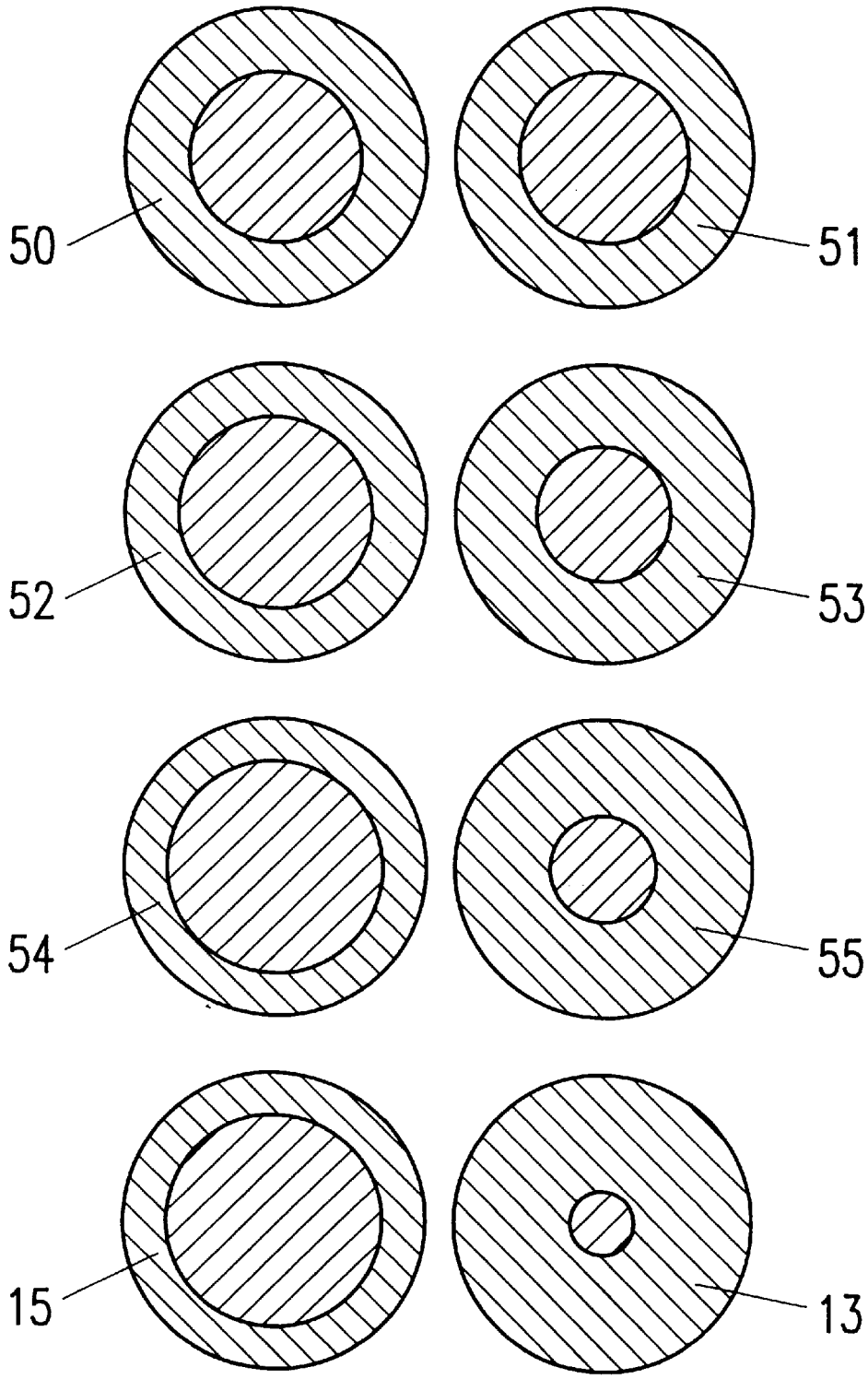
FIG. 2 shows equal cross-sectional areas of different pairs of metering cylinder/displacement plunger combinations for different ratios along line II—II.

FIG. 2 shows examples of four pairs of metering cylinder/displacement plunger combinations, the cross-sectional area of each metering cylinder/displacement plunger combination within each pair forming a ratio in relation to the other such that displacement plungers 50 & 51 form a 1:1 ratio, 52 & 53 form a 2:1 ratio, 54 & 55 form a 4:1 ratio and 13 & 15 form a 10:1 ratio. Furthermore, the total cross-sectional area of any pair of metering cylinder/displacement plunger combination substantially equals that of any other pair. This feature ensures similar metering pressures, whatever the ratio, and therefore maximizes the metering pump component pressure capabilities.

Figure 3:
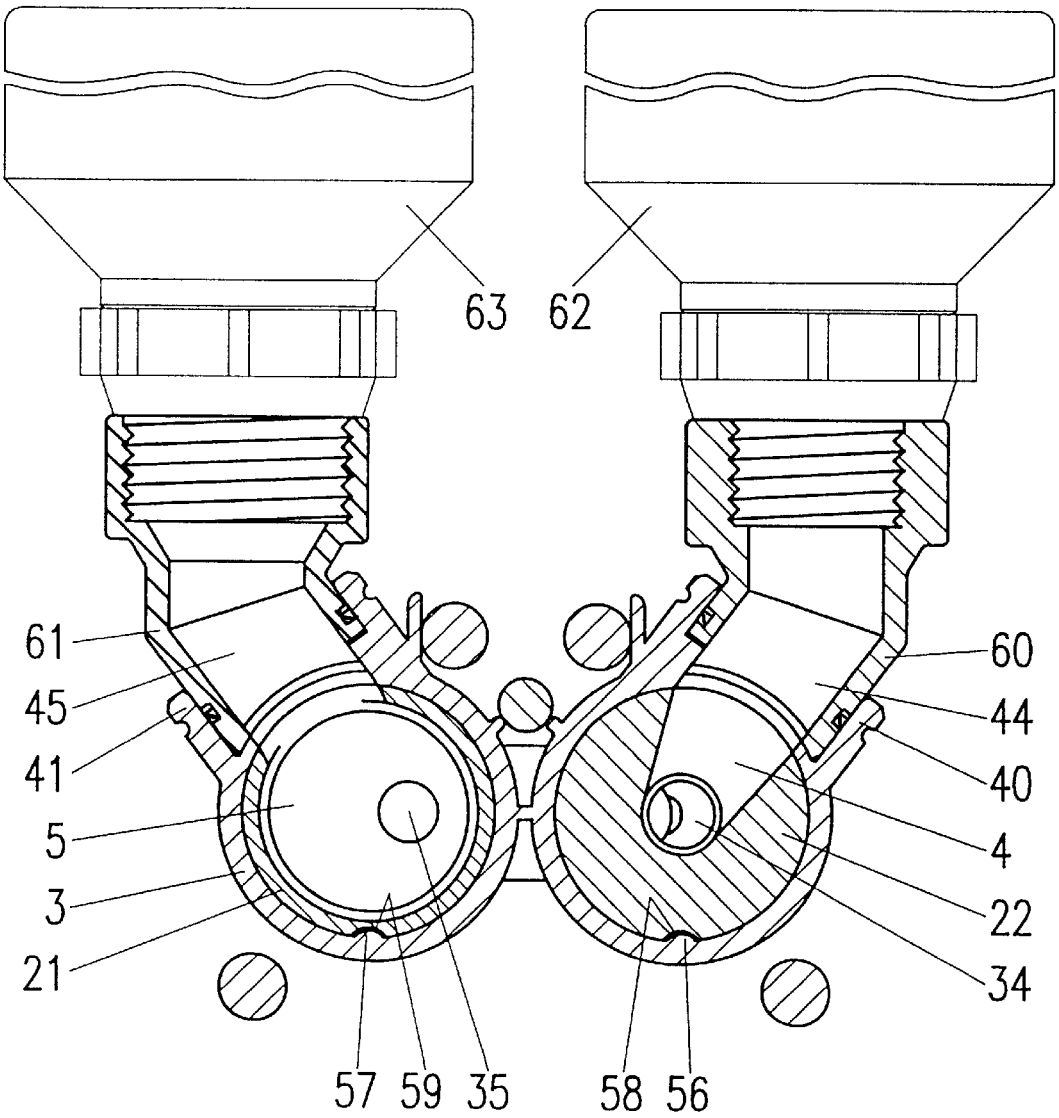
FIG. 3 shows a cross-sectional view along line III—III of FIG. 1 of a detail of the assembly of FIG. 1.

FIG. 3 shows a cross sectional view through metering pump assembly 1, FIG.1, within the area of the double inlet 3, with inlets 40 and 41, inlet spacer 21 and inlet spacer seal housing 22, the latter two having bore sizes slightly larger than those of the displacement plungers. Furthermore, the inlet spacer 21 and the inlet spacer seal housing 22 have keyways 58 & 59 which mate with keys 56 & 57, the latter formed within the double inlet 3 so as to ensure the correct orientation to prevent rotation and misalignment of the passageways 44 & 45 relative to inlets 40 & 41. The inlets being inclined upwards to form a V-shape so that when fitted with the angled adaptors 60 & 61, containers 62 & 63 are able to be positioned parallel to each other.

Figure 4:
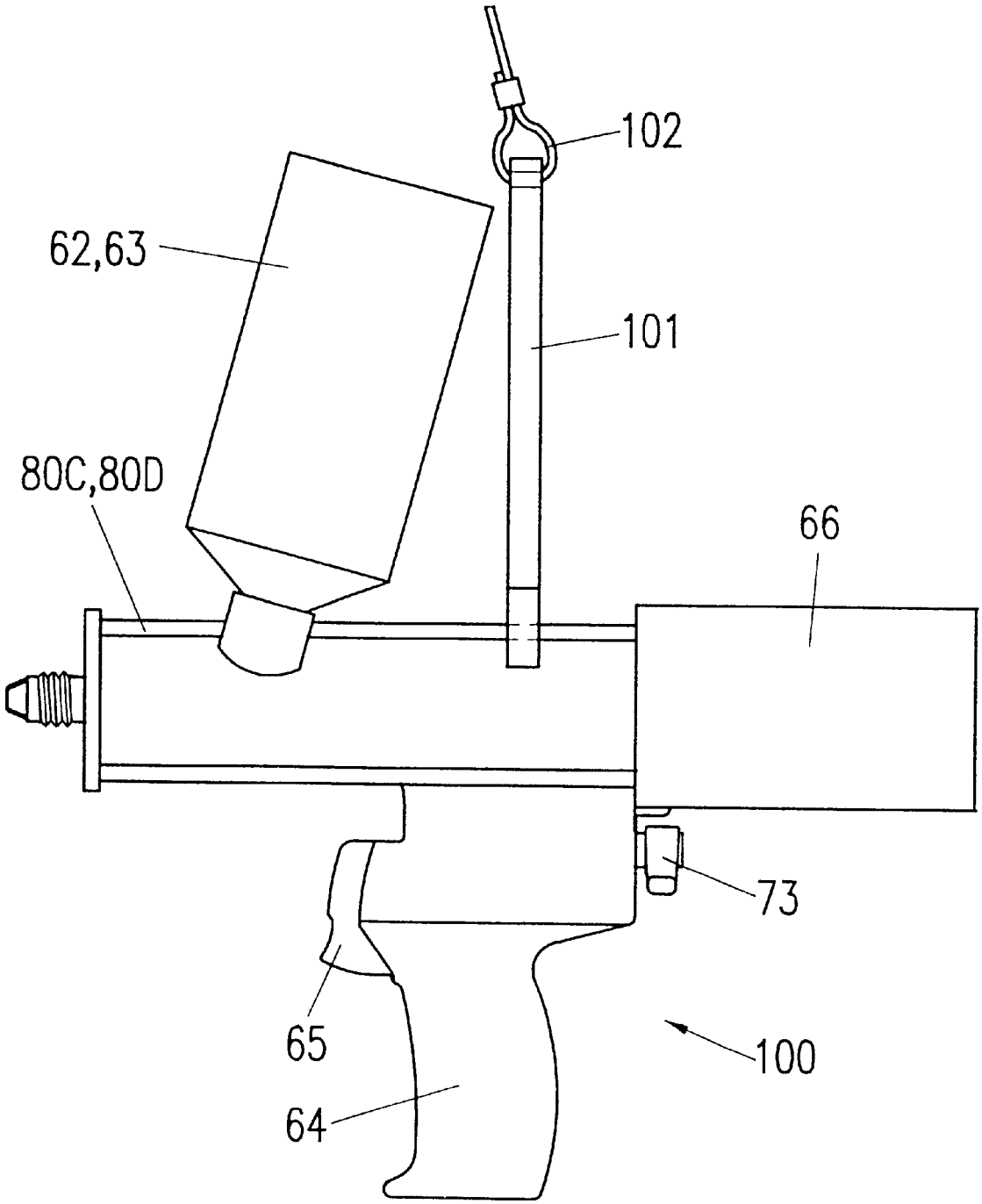
FIG. 4 shows a side view of the complete appliance assembly with a suspension device, FIG. 5 essentially shows a cross-sectional view along line V—V in FIG. 1.

FIG. 4 shows a portable metering and mixing appliance assembly 100 with a longitudinally slidingly adjustable and self locking suspension bracket 101 attached to upper tie rods 80C & 80D for connection to a suspension device such that the center of gravity of the complete appliance is well below the point where a flexible suspension line 102 connects to the adjustable suspension bracket 101, thus ensuring a stable position of the unit yet allowing the appliance to move freely. As follows from this Figure the parallel containers 62 and 63 are vertical or are inclined towards the rear of the unit at an angle between 90° to 65° relative to the longitudinal pump axis. FIG. 4 further shows the handle 64 with trigger 65. The drive unit 66 is symbolized, which can be an electrical, pneumatic or manual drive unit.

Figure 5:
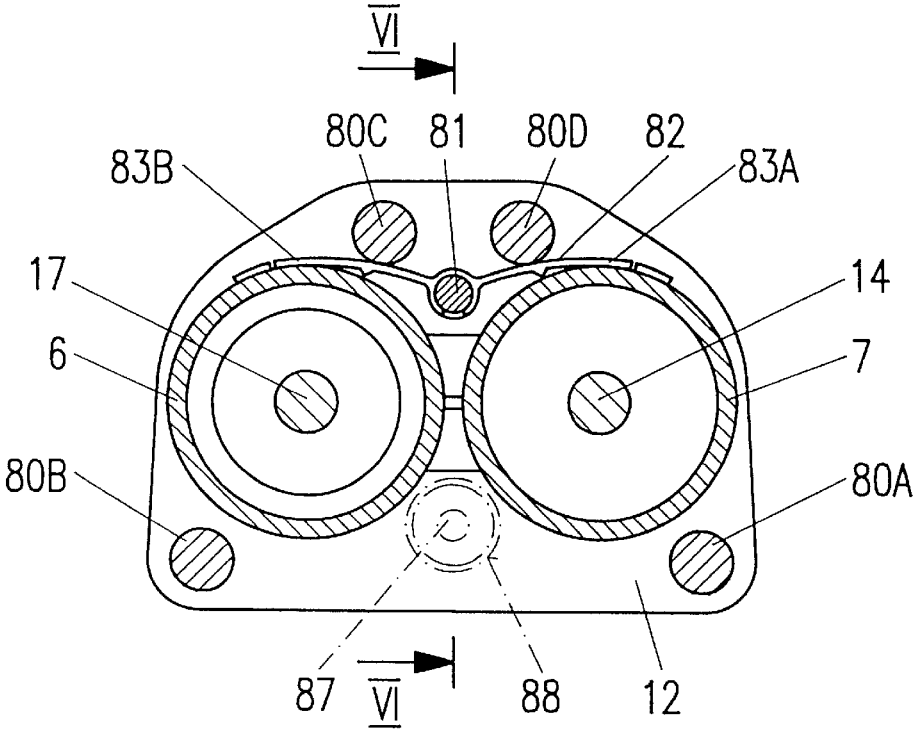
Figure 6:
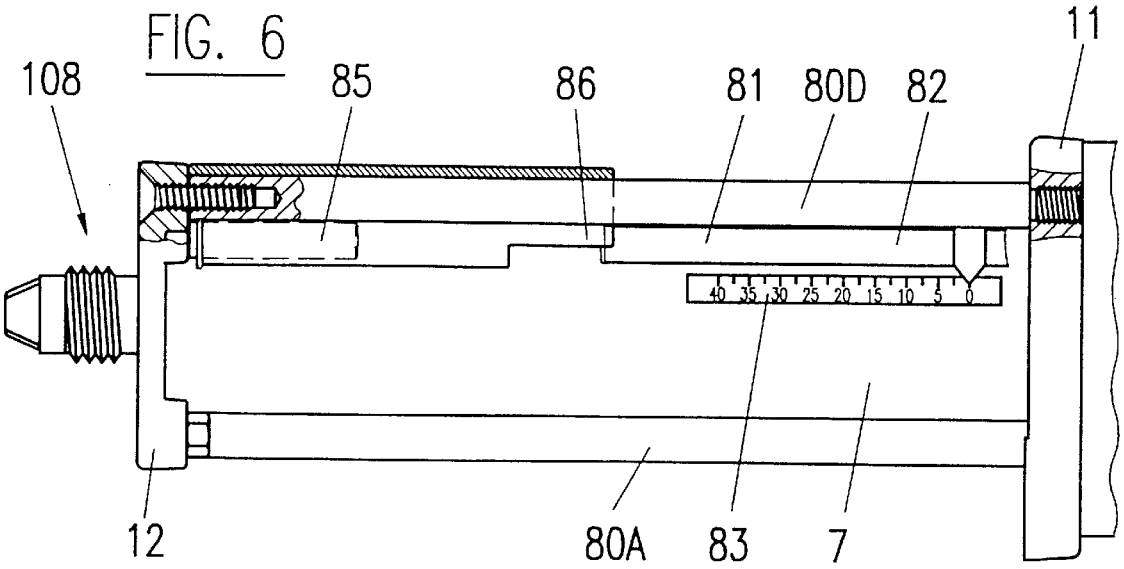
FIG. 6 shows a view along line VI—VI in FIG. 1, and, FIGS. 7A and 7B show a side and rear view of the dispensing appliance handle together with the combined mode of operation selector switch and push button.

FIGS. 5 & 6 show a retaining system for the metering pump assembly 1, with four tie rods 80A,80B,80C,80D and front plate 12 which attach the metering pump assembly to the drive unit front flange 11 as shown in FIG. 1. FIG. 6 shows an indicator rod 81 having an indicator 82 attached which indicates the volumetric output against scales 83A & 83B located on the rear sleeves 6 & 7. Indicator rod 81 also has a secondary function as that of controlling the metering stroke length by making contact with, and stopping against, a stroke spacer 85 which may be varied in length according to the required metering volume, the stroke spacer 85 being held in position by a quick release bracket 86.

The invention has been described and explained for an assembly having two components and a double outlet and a double inlet. It is evident that with the addition of more components the outlet will be a multiple outlet and the inlet a multiple inlet, whereas the multiple outlet ends in a common outlet for attaching a mixer or the like. Thus, a third drive rod 87, FIG. 5, is optionally provided for a third metering pump assembly 88 for the metering of an additional minor component of chemical liquid, the position of which may be as shown or, for instance, the whole arrangement may be reversed with the third pump being above the other two.

Figure 7A:
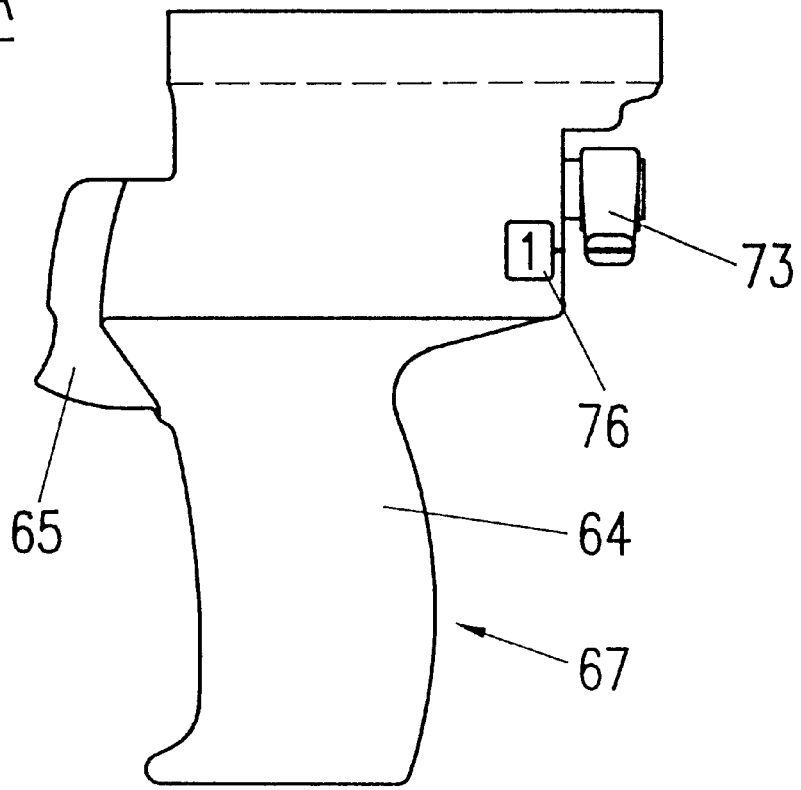
Figure 7B:
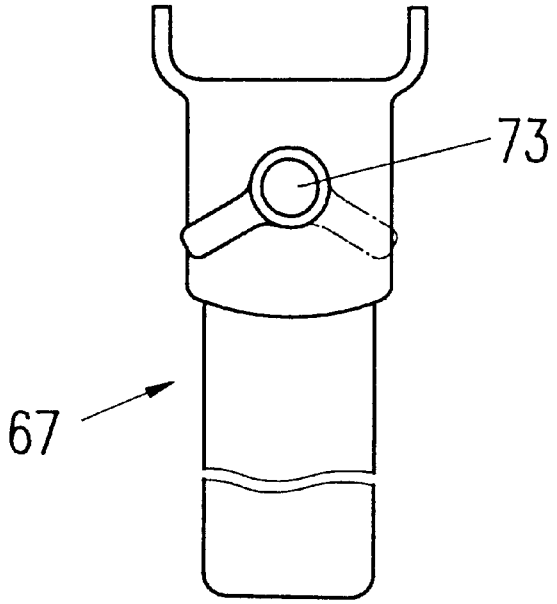

FIG. 7A & 7B show side and rear views of the appliance handle assembly 67 comprising handle 64, trigger 65 and mode of operation selector switch 73 acting also as a push button in mode 1. The mode of operation selector switch 73 has approximately 120 to 180 degrees of switch movement between the two modes 1 and 2. In position 1 of the selector switch, as indicated by mode display 76, the metering plungers are driven forward by pulling the trigger 65 and stop upon release of the trigger 65, with the metering plungers being driven rearward for metering pump reload only via use of the selector switch 73 as a push button. In position 2, (shown by dotted lines), the metering plungers are driven forward for metering by pulling of the trigger 65 and automatically driven rearwards when the trigger 65 is released.

It follows that the invention, as described above, provides for an improved and highly compact unit design utilising modular and interchangeable components for the mass production of compact and relatively low cost metering and mixing machines for multi-component reactive chemical systems with accurate performance and versatility of use.

This is achieved by optimising and matching the stress capability of component parts in regard to hydraulic displacement forces through the use of pairs of metering cylinder/displacement plunger combinations with their diameters not only according to the required volumetric mixing ratios but such that the sum of their cross sectional areas remain substantially equal for all mixing ratios and therefore maximizes the working pressures for all ratios. This is further achieved by breaking down the equipment into modular interchangeable components which are suitable for high volume/low cost manufacture by such processes as plastic injection moulding and metal die-casting.

The invention also covers the need for the exact metering pump alignment relative to the drive rods, a method for attachment of containers to a compact side by side metering assembly yet allowing them to be attached parallel to each other, an optional third component pump which is usually required for very minor components, a visual metered output indicator so that an operator may visually control a metered output, a mechanical adjustment for a specific shot volume and finally, an adjustable suspension bracket for hand held units such that it may be suspended and counterbalanced while allowing the unit to move freely with attached containers.

As with the appliance according to European Patent Application 607,102, the drive rods 14 and 16 may be actuated either by an electrically, pneumatically or manually operated drive.

The invention claimed is:

1. Dispensing appliance for at least two components, comprising:

a pump assembly having an outer housing, a dispensing side, and a drive side;

at least two metering cylinders, one for each of the at least two components, the at least two metering cylinders being contained within the housing and being removable from the housing, each of the at least two metering cylinders having an inlet for receiving one of the at least two components, an outlet, and an associated displacement plunger, the outlets of the at least two metering cylinders ending in a common outlet, each outlet having an eccentric outlet nose that is located between a central longitudinal axis of the respective metering cylinder and a central longitudinal axis of the pump assembly; and a frame for holding the pump assembly and comprising a front frame plate on the dispensing side thereof and a rear frame plate on the drive side thereof, the front and rear frame plates being detachably connected to each other by tie rods, wherein each of the at least two metering cylinders are exchangeable from within the outer housing with at least one other metering cylinder having a different inner diameter, thereby to determine a ratio of components ejected from the common outlet.

2. Appliance according to claim 1, wherein each eccentric outlet nose includes a pressure differential check valve.

3. Appliance according to claim 2, wherein each eccentric nose outlet includes a valve seat, and each pressure differential check valve comprises a poppet valve that seals against the respective valve seat.

4. Appliance according to claim 1, wherein a total cross-sectional area of any pair of metering cylinder/displacement plunger combinations is the same.

5. Dispensing appliance for at least two components, comprising:

a pump assembly having an outer housing, a dispensing side, and a drive side;

at least two metering cylinders, one for each of the at least two components, the at least two metering cylinders being contained within the housing and being removable from the housing, each of the at least two metering cylinders having an inlet for receiving one of the at least two components, an outlet, and an associated displacement plunger, each outlet of the at least two metering cylinders ending in a common outlet; and a frame for holding the pump assembly and comprising a front frame plate on the dispensing side thereof and a rear frame plate on the drive side thereof, the front and rear frame plates being detachably connected to each other by tie rods, wherein the dispensing appliance is adapted for use with a plurality of metering cylinder/displacement plunger combinations, wherein each of the at least two metering cylinders are exchangeable from within the outer housing with at least one other metering cylinder having a different inner diameter, thereby to determine a ratio of components ejected from the common outlet, and wherein a total cross-sectional area of any pair of metering cylinder/displacement plunger combinations is the same, and each pair has a displacement plunger diameter ratio within the range of 1:1 to 20:1.

6. Appliance according to claim 1 or 5, further comprising rear seal assemblies located at a rear of each inlet, and metering seals located in front of each inlet either within a recess at the inlet side of the metering cylinder or adjacent to the inlet side of the metering cylinder.

7. Appliance according to claim 1 or 5, wherein at least one displacement plunger is connected to a corresponding drive rod via an adjustable adaptor ring for axial adjustment of the at least one displacement plunger.

8. Appliance according to claim 1 or 5, wherein the at least two metering cylinders are side by side and have external flanges, and the housing consists of three external sections, namely a front section that includes each outlet of the at least two metering cylinders and two forward sleeves and the common outlet, an inlet section that includes each inlet of the at least two metering cylinders and a rear section that includes rear sleeves, wherein the external flanges of the at least two metering cylinders are secured to the forward sleeves.

9. Appliance according to claim 8, wherein each inlet of the the inlet section of the housing is inclined upwards to form a V-shape, each inlet being connected to an angled adaptor for positioning detachable containers parallel to each other.

10. Appliance according to claim 1 or 5, further comprising four tie rods that hold the pump assembly together and that extend between the rear frame plate and the front frame plate, the rear frame plate having alignment ridges for properly locating and aligning the pump assembly.

11. Appliance according to claims 1 or 5, further comprising a third metering cylinder contained in another pump assembly having another drive side with a drive rod, the another pump assembly being located in at least one of a position beneath the pump assembly containing the at least two metering cylinders and a position above the pump assembly containing the at least two metering cylinders.

12. Appliance according to claim 1 or 5, further comprising an indicator rod with an indicator for indicating volumetric output against a scale located on a rear section of the pump assembly, and a stroke spacer located on a center line of the indicator rod and supported against the front frame plate by a quick release bracket for limiting the metering stroke length.

13. Appliance according to claim 1 or 5, wherein a rear section of the pump assembly has rear sleeves, and the rear sleeves are aligned by alignment ridges and are provided with cut outs adjacent to the rear frame plate for observing potential leakage and/or for axial adjustment of each displacement plunger.

14. Appliance according to claim 1 or 5, further comprising a self-locking suspension bracket located between the inlets of the at least two metering cylinders and the rear frame plate, and a flexible suspension line attached to the self-locking support bracket and two of the tie rods, wherein the rear frame plate is attached to and is longitudinally adjustable along the two of the tie rods.

15. Appliance according to claim 1 or 5, further comprising at least two containers, one attached to the inlet of each of the at least two metering cylinders, wherein the at least two containers are at least one of vertical and inclined towards the rear frame plate at an angle between 90° and 65° relative to a longitudinal axis of the pump assembly.

16. Appliance according to claim 1 or 5, wherein each inlet of the at least two metering cylinders has a housing, the inlet of one of the at least two metering cylinders has an inlet spacer positioned within the inlet housing, and the other of the at least two metering cylinders has an inlet spacer seal housing positioned within the inlet housing, and the inlet spacer and the inlet spacer seal housing have keyways that mate with keys formed in each inlet housing for proper orientation and alignment.

17. Appliance according to claim 1 or 5, wherein further comprising a handle assembly with a handle, a trigger and a mode of operation selector switch for selecting between two different modes of operation.

18. Appliance according to claim 1 or 5, wherein, for each of the at least two metering cylinders, the housing includes a front sleeve section, a rear sleeve section, and an inlet section.

19. Appliance according to claim 18, further comprising first sealing means sealing each of the at least two metering cylinders between an outer diameter of the respective eccentric outlet nose and the respective outlet, and second sealing means sealing each of the at least two metering cylinders between an outer diameter of each of the at least two metering cylinders and an inside diameter of a respective inlet section of the housing.

20. Appliance according to claim 1 or 5, wherein an outermost diameter of each of the at least two metering cylinders is the same as an outermost diameter of the at least one other metering cylinder.

21. Appliance according to claim 1 or 5, wherein the housing has a separate housing section for carrying each of the at least two metering cylinders, and a cross section of each separate housing section is equal to a cross section of each other separate housing section.

* * * * *